United States Patent [19]

Gmuer et al.

[11] 4,191,004

[45] Mar. 4, 1980

[54] BAG FOLDING APPARATUS

[76] Inventors: Bruno Gmuer, Boppartstrasse 32, 9014 Sankt Gallen; Willy Grundbacher, Poststrasse 20, 9220 Bischofszell, both of Switzerland

[21] Appl. No.: 880,360

[22] Filed: Feb. 23, 1978

[30] Foreign Application Priority Data

Feb. 24, 1977 [CH] Switzerland ..... 2293/77

[51] Int. Cl.[2] ..... B65B 7/08

[52] U.S. Cl. ..... 53/378

[58] Field of Search ..... 53/371, 378, 379, 139

[56] References Cited

U.S. PATENT DOCUMENTS

| | | | |
|---|---|---|---|
| 2,356,472 | 8/1944 | Rothaug | 53/373 X |
| 2,576,472 | 11/1951 | Messmer et al. | 53/371 X |
| 2,641,880 | 6/1953 | Stone | 53/371 X |
| 2,697,473 | 12/1954 | Techtmann | 53/373 X |
| 2,987,106 | 6/1961 | Sylvester et al. | 53/373 X |
| 3,167,897 | 2/1965 | Hopkins et al. | 53/371 X |
| 3,381,448 | 5/1968 | Ayres et al. | 53/373 |
| 3,720,559 | 3/1973 | Odom et al. | 53/378 X |

*Primary Examiner*—Horace M. Culver

*Attorney, Agent, or Firm*—Toren, McGeady and Stanger

[57] ABSTRACT

In a bag folding apparatus, a filled bag is moved through a bag closing station with the open end of the bag passing through a space bounded on the opposite sides by a pressure application band and a countersurface of a folding ledge. The open end of the bag projects above the folding ledge and a folding device turns the open end downwardly over the folding ledge against the side opposite the counter surface. The folding ledge is coextensive in the direction of the bag extending between its closed and open ends with the pressure application band, and the folding ledge is elastically supported from an overhead bar by stirrups so that a free space is available for folding the open end of the bag downwardly against the folding ledge.

19 Claims, 10 Drawing Figures

BAG FOLDING APPARATUS

SUMMARY OF THE INVENTION

The invention relates to a bag folding apparatus for folding those edge regions of filled bags which are adjacent to the bag opening, having a conveying device for the bags, having a pressure application band for those regions of the conveyed bags which are adjacent to the edge regions of the opening, driving and deflecting rollers turning this pressure application band about axes which, at least approximately, extend parallel to the axes of the bags, and having a folding device for the edge regions arranged in the vicinity of the pressure application band.

In known bag folding apparatuses the counter-surface of the pressure application band is formed by a similar second pressure application band arranged parallel to the first. The region of the conveyed bag which is adjacent to the edge regions of the opening is gripped by the two pressure application bands and is taken along. When the bags are standing upright, the folding is performed above the two pressure application bands since the folding region of the folding device must be arranged above the pressure application region of the pressure application bands and above the structural height required for this purpose so that the necessary space for the folded end of the bag is available.

The invention allows, the simple means, the realization of significant savings in the material required for the bags.

The inventive bag folding apparatus is characterized in that the folding region of the folding device and the pressure application region of the pressure application band overlap at least partially.

Due to the overlapping of the two regions it is possible to use shorter bags.

In a further development of the invention the counter-surface of the transporting band has a, preferably sliding, folding ledge in the pressure application region, the mounting supports of the folding ledge leaving a free space for the edge region at the bag opening to be folded over. The edge region at the bag opening can be folded over the folding ledge. Since there is a single pressure application band, the conditions for driving are simpler.

The quality of work and the reliability of operation are increased when the active areas of the folding ledge have a low-friction surface. This low-friction surface is obtained by special working, surface treatment or coating. The active areas, to wit, the pressure application surface and the folding edge may, for example, be polished or provided with a coating of polytetrafluorethylene.

A simple adaptation for using the apparatus for bags that are not to be folded results, in a bag folding apparatus wherein the driving and deflecting rollers of the pressure application band are mounted in the housing of a frame, if the folding device can be mounted at the housing by means of snap closures.

If the folding ledge is elastically suspended at the frame by means of stirrups, particularly if the stirrups are made of spring steel, the folding ledge is elastically and securely pressed against the pressure application band.

A simple construction results if a bar for receiving the stirrups is mounted at the housing of the frame, which bar, at least approximately, extends parallel to the pressure application band and the folding ledge. This bar is advantageously provided with cross bores for inserting the stirrups.

The pressure application force of the folding ledge can be controlled if the stirrups are provided with a device for adjusting the length of insertion. The position of the folding ledge adjusts itself if sleeves for receiving fastening screws for the folding ledge are mounted at the stirrups, the axes of the sleeves extending parallel to the folding ledge.

The height of the position of the folding ledge can be chosen as desired, if the stirrups are vertically adjustable.

A space remains when folding the fold over the folding ledge. Therefore, it is advantageous to arrange, following the folding ledge, a pair of pressure application rollers for smoothing the folds. However, the driving conditions remain very simple if one of the pressure application rollers is mounted on the axis of the driving roller of the pressure application band and if the other pressure application roller rotates along merely due to friction.

The two pressure application rollers can be pressed against one another in a simple and effective manner if the bearing of the second pressure application roller is suspended at the bar for receiving the stirrups by means of elastic sectional members, particularly if the sectional members are inserted into the bar in a similar manner as the stirrups. Advantageously, this bearing of the second pressure application roller can be clamped to a pin whose direction is parallel to the bar. This pin is supported by the sectional members and is held in a fixed position.

To facilitate the conveying of the bag, the pressure application band may have a surface which increases the friction. For this purpose, the pressure application band may be contructed as a toothed belt or as a chain. Particularly advantageous is a construction of the pressure application band in the form of a belt having teeth on both sides since thus, as in a chain, a drive without slippage is ensured.

The bag folding apparatus is primarily intended for the formation of complete processing lines together with other machines.

For example, the bag folding machine may be followed by a bag sewing machine. It can also be preceded by a bag spreading apparatus.

The drawing schematically shows an embodiment of the invention as an example.

BRIEF DESCRIPTION OF THE DRAWING

FIG. 2 is a plan view in larger scale of the bag folding apparatus of FIG. 1. The supporting structure and the bag conveying device are not shown. Some parts are shown in the broken away in order to be able to show the details located underneath.

DETAILED DESCRIPTION OF THE INVENTION

Figure 1:
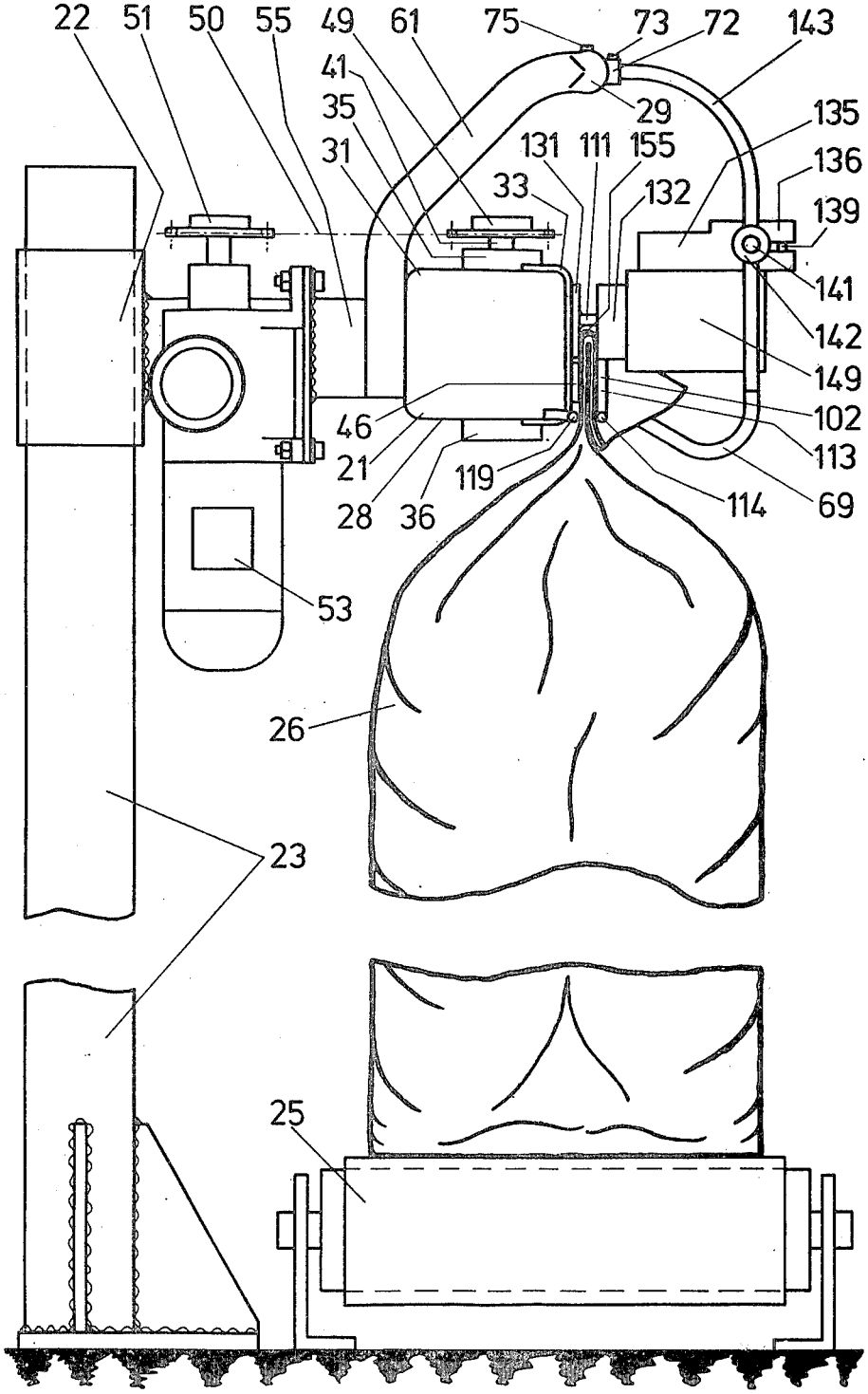
FIG. 1 is a side view of the inventive bag folding apparatus, seen in the direction of arrow I in FIG. 2, at the output side.

An inventive bag folding apparatus (FIG. 1) has a frame 21 which is supported securely but vertically adjustably on a column 23 by means of a supporting arm 22. A conveyor belt 25 conveys the filled bags 26 standing upright, the bags at first being open at the top.

The main parts of the frame 21 are a housing 28 and a bar 29. The housing 28 (see, for example, FIG. 6) consists primarily of a supporting sectional member 31 having a deep U-shaped cross section; a front plate 33 having a relatively shallow U-shaped cross section is screwed to the member 31.

Screwed to the supporting sectional member 31 are bearings 35 to 38 for the vertical axle 41 of the driving roller 42 and for the axle 43 of the deflecting roller 44 of a pressure application band 46. In order to increase the friction of the pressure application band 46 and to ensure that it is driven without slippage, it is contructed on both sides as a toothed belt 47. A chain wheel 49 is mounted on the axle 41 of the driving roller 42. The chain wheel 49 is driven by the chain wheel 51 of a variable-speed motor 53 through a drive chain 50. The variable-speed motor 53 is screwed onto the supporting sectional member 31 through a support 55.

The bar 29 extends horizontally above the housing 28, parallel to the pressure application band 46. The bar 29 is provided with curved side portions 61 to which there are welded plates 62 which, in turn, are screwed to the supporting sectional member 31.

As counter-surface for the pressure application band 46 serves a folding ledge 65 which has a folding edge 66. The folding ledge 65 is suspended from the bar 29 through stirrups 67 of spring steel. In order to facilitate vertical adjustment of the folding ledge 65, the stirrups 67 are vertically adjustable. The stirrups 67 consist of an upper part 68 and a lower part 69 which are longitudinally adjustably screwed into a sleeve 70. The bar 29 has cross bores 71 for inserting the stirrups 67. For adjusting the pressure application force of the folding lede 65 in the direction of the pressure application band 46, the stirrups 67 are provided with a device for adjusting the length of insertion. This device consists of rings 72 which can be locked onto the stirrups 67 by means of screws 73. The stirrups 67 are mounted in the cross bores 71 by means of screws 75. Sleeves 77 are attached to the stirrups 67, the axes 78 of the sleeves 77 extending parallel to the folding ledge 65. The sleeves 77 receive fastening screws 79 and are held by the lugs 80 of the folding ledge 65.

Figures 7, 9:
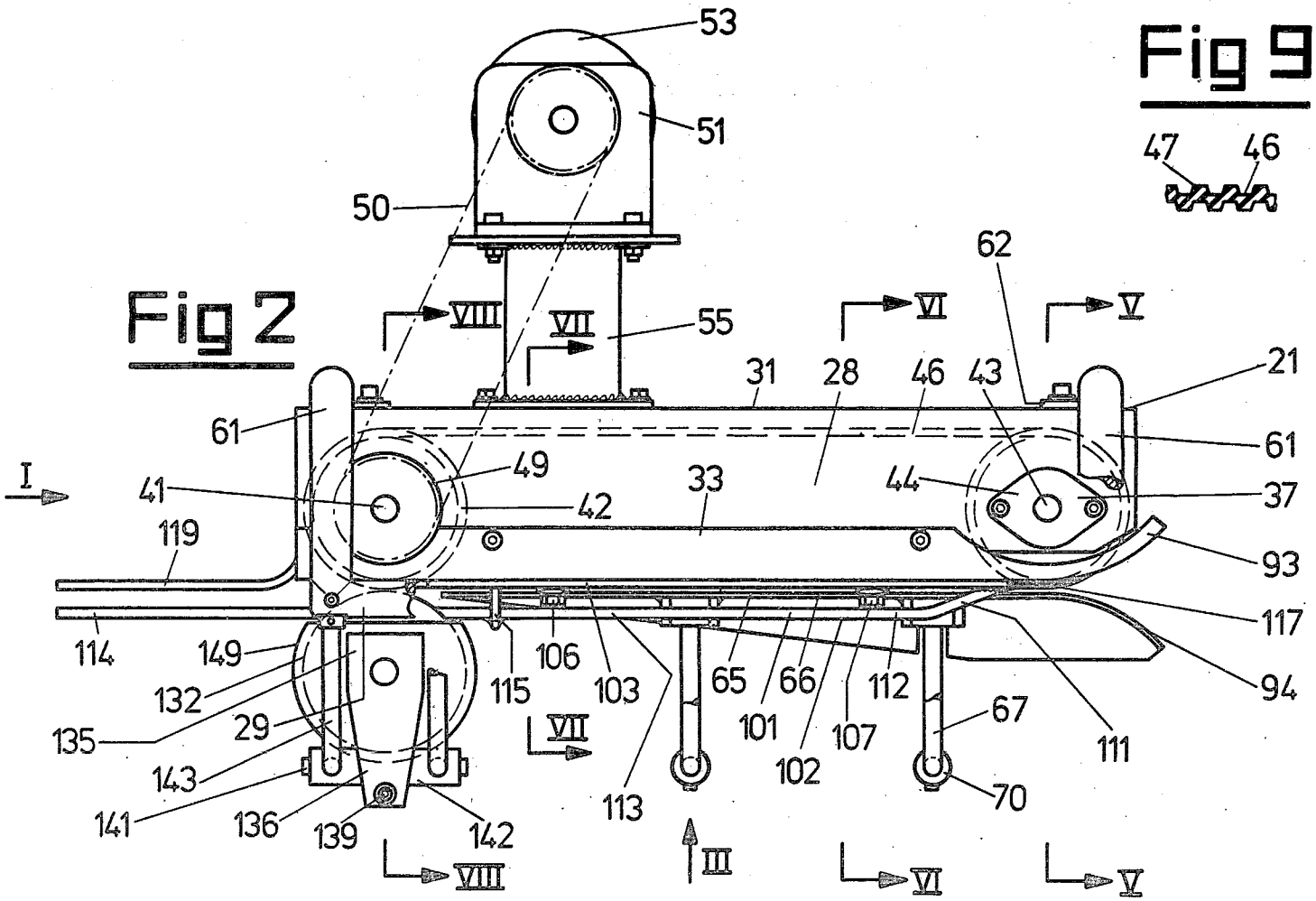
FIG. 7 is a section cut along the line VII—VII of FIG. 2. The drive motor is not shown.
FIG. 9 shows a plan view of a portion of the pressure application band.
Figure 3:
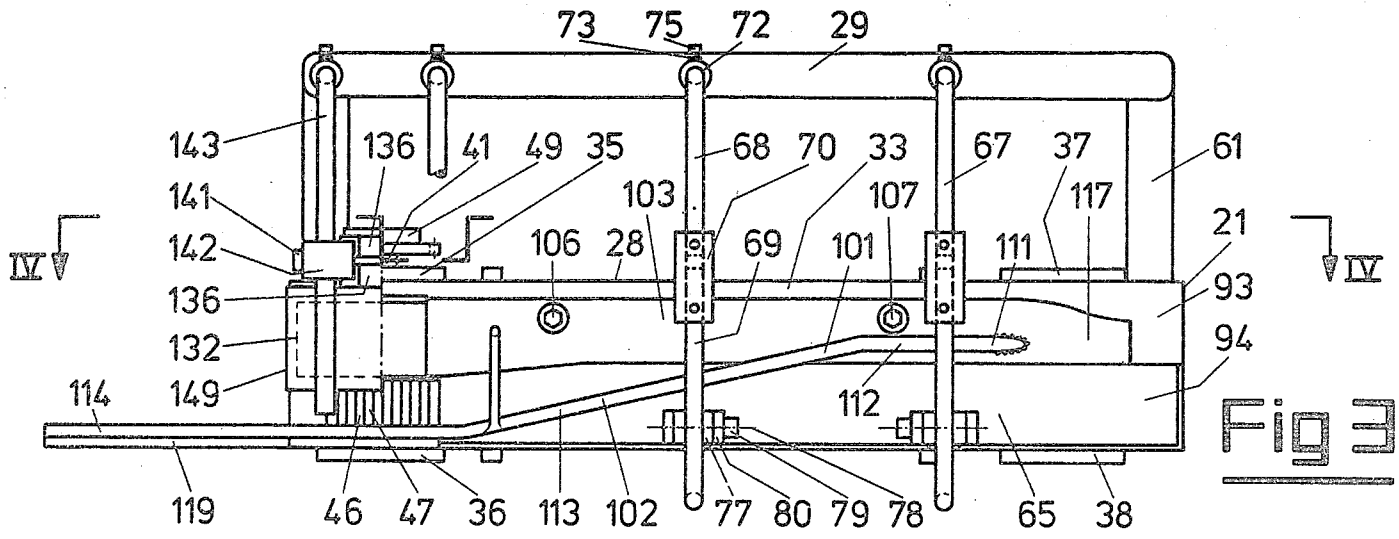
FIG. 3 is a front view seen in the direction of arrow III of FIG. 2. The drive motor is not shown.
Figure 4:
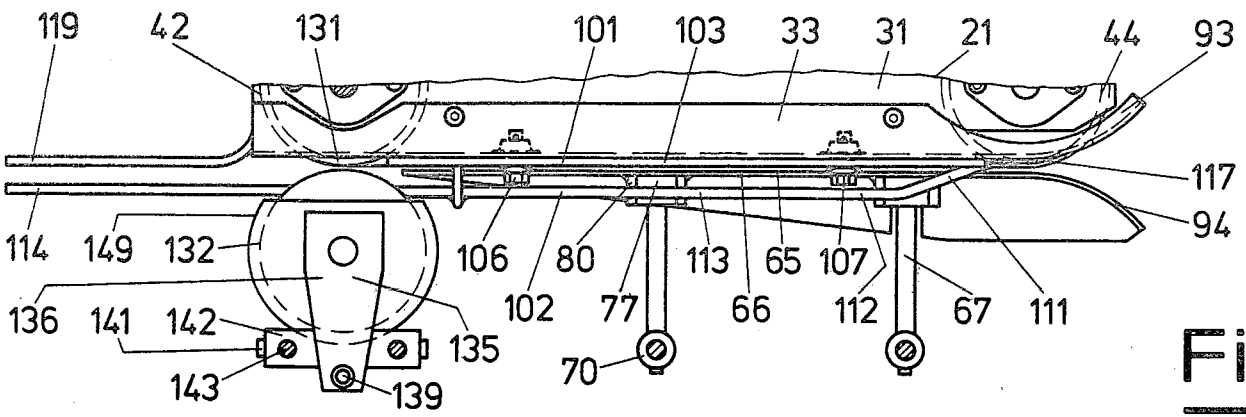
FIG. 4 is a partial plan view in section cut along the line IV—IV of FIG. 3.
Figure 6:
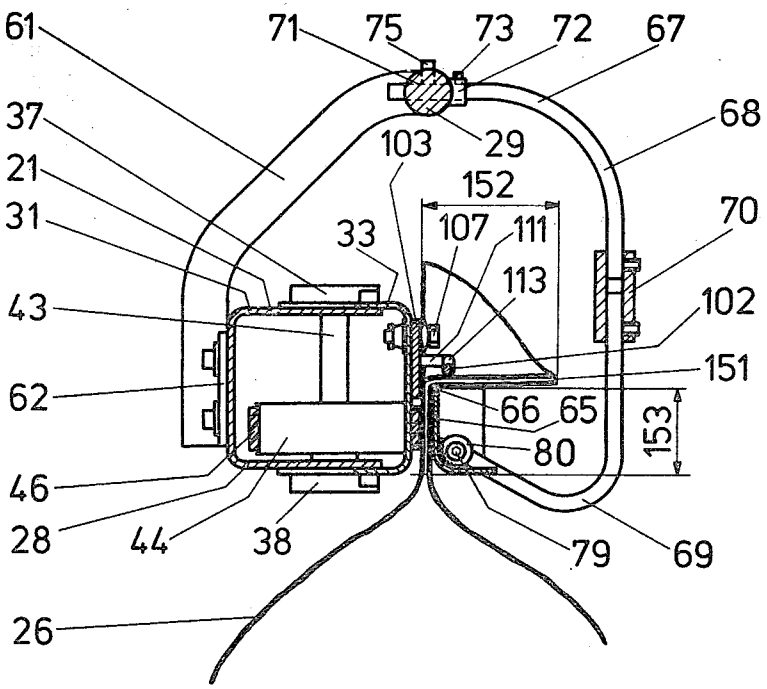
FIG. 6 is a section cut along the line VI—VI of FIG. 2.

At the input side, the front plate 33 has a curved inlet part 93 and the folding ledge 65 a curved inlet part 94. The front plate 33 has an opening at the driving roller 42 (FIG. 8) and at the deflecting roller 44 (FIG. 5) in order to allow the pressure application band 46 to emerge from the housing 28. Therebetween the pressure application band 46 is supported by the lower part of the front plate 33 (FIGS. 6 and 7).

The folding device 101 is formed by a bar 102 serving as a curved cam. The bar 102 is mounted on a supporting plate 103. The supporting plate 103 is rigidly attached to the upper part of the front plate 33 by means of two snap closures 106, 107. At the input side the bar 102 is welded to the supporting plate 103. The bar 102 has a first section 111 which extends horizontally away from the plate 33 and projects beyond the folding edge 66 and the vertical part of the folding ledge 65; a second section 112 which extends horizontally parallel to the front plate 33; a descending third section 113 which extends parallel to the front plate 33; and a horizontal fourth section 114 which extends horizontally, also parallel to the front plate 33. At the third section 113, the bar 102 is supported by a stirrup 115. This stirrup 115 is welded to the front plate 33 and the bar 102. At the input side, the supporting plate 103 has a curved part 117 which reaches into an opening of the front plate 33. At the output side, a bar 119 is mounted which extends essentially parallel to the bar 102.

At the output side, following the folding ledge 65, two pressure application rollers 131, 132 are arranged for smoothing the fold. The pressure application roller 131 is mounted on the axle 41 of the driving roller 42 of the pressure application band 46. The second pressure application roller 132 is mounted in an overhung position freely rotatable in a bearing 135. The bearing 135 is clamped onto a horizontal pin 142 through a support 136 and through the screw bolt 139. This pin 142 is itself clamped to sectional members 143 by means of screws 141. The elastic sectional members 143 are, in a similar manner as the stirrups 67, inserted and secured in the bar 29. Thus, the pressure application force of the two pressure application rollers 131, 132 can be adjusted. The parallelism of these two pressure application rollers 131, 132 can also be adjusted by changing the position at which the support 136 is clamped. The support 136 carries a hood 149 for the pressure application roller 132.

Figure 5:
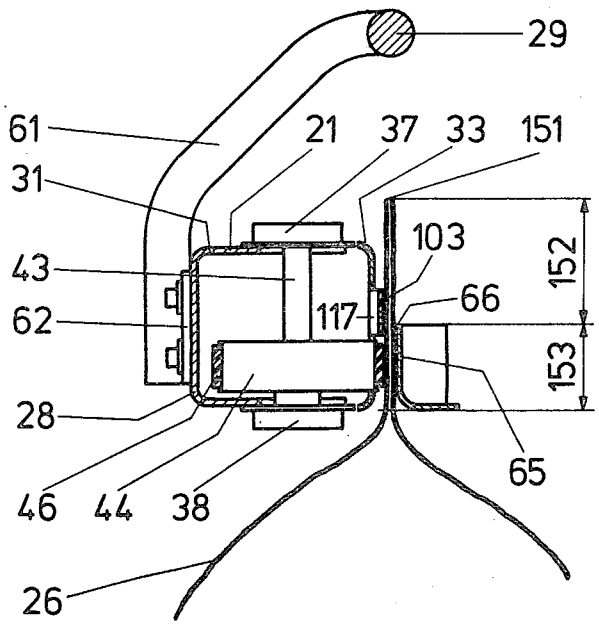
FIG. 5 is a section cut along the line V—V of FIG. 2.

The operation is as follows:

The open bags filled in a bag filling machine are conveyed in a known manner in an upright position by the conveyor belt 25. First, the edge regions adjacent to the opening of a bag 26 are spread open by hand or by a bag spreading apparatus parallel to the conveying direction. The upper portion of the bag 26 travels into the inlet zone of a bag closing station containing the bag folding apparatus, the inlet zone being formed by the curved parts 93, 94, 117. In the position of FIG. 5, this upper portion of the bag 26 is fastened between the pressure application band 46 and the folding ledge 65, and is taken along by the pressure application band 46 which runs at the same speed as the conveyor belt 25. The edge regions adjacent to the opening 151 of the bag 26 above the folding ledge 65 are denoted by reference numeral 152. The portions of the bag 26 which are adjacent to the edge regions 152 and are under the influence of the pressure application band 46 and the folding ledge 65 are denoted by reference numeral 153.

The edge regions 152 travel to the bar 102 of the folding device 101 and are bent approximately to the horizontal direction by the section 111 of this bar 102. After leaving the section 112, they reach the influence of the section 113, as shown in FIG. 6.

During further travel along the section 113 the edge region 152 is now folded over the folding edge 66 against the vertical outer side of the folding ledge 65 (FIG. 7).

Figure 8:
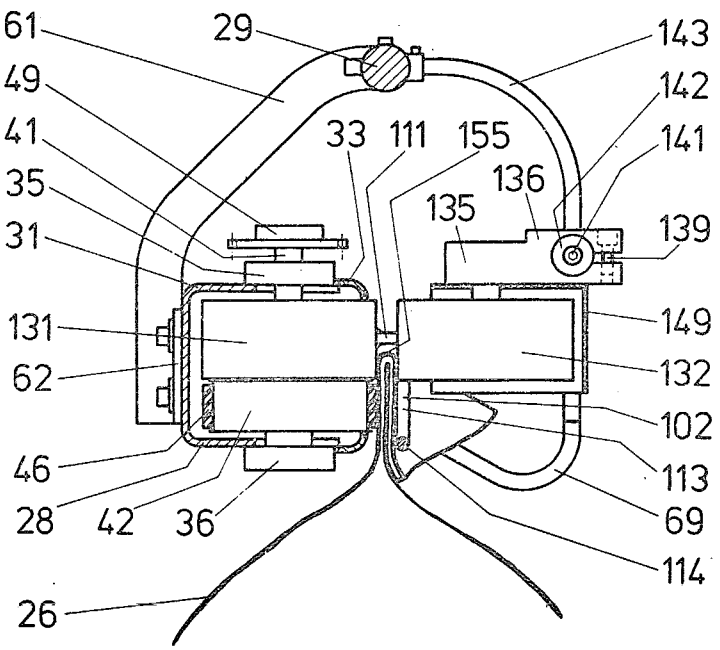
FIG. 8 is a section cut along the line VIII—VIII of FIG. 2. The drive motor is now shown.
Figure 7:
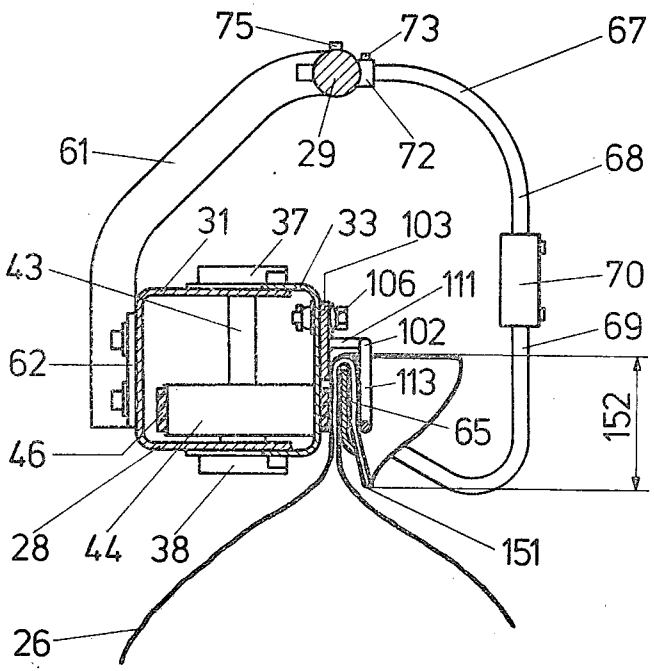

In the course of further travel, the upper portion of the bag 26 leaves the folding ledge 65 and reaches the region of the pressure application rollers 131, 132 where the fold 155 is smoothed (FIG. 8). The upper portion of the bag 26 leaves the bag folding apparatus under guidance through the section 114 of the bar 102 and through the bar 119 which extend into the region of a subsequent bag closing device. The bag 26 is guided through the conveyor belt 25 to this bag closing device, preferably a bag sewing machine.

A look at FIGS. 6 and 7 shows that the overhung design of the stirrups 67 leaves a free space for the edge regions 152 to be folded over.

Figure 10:
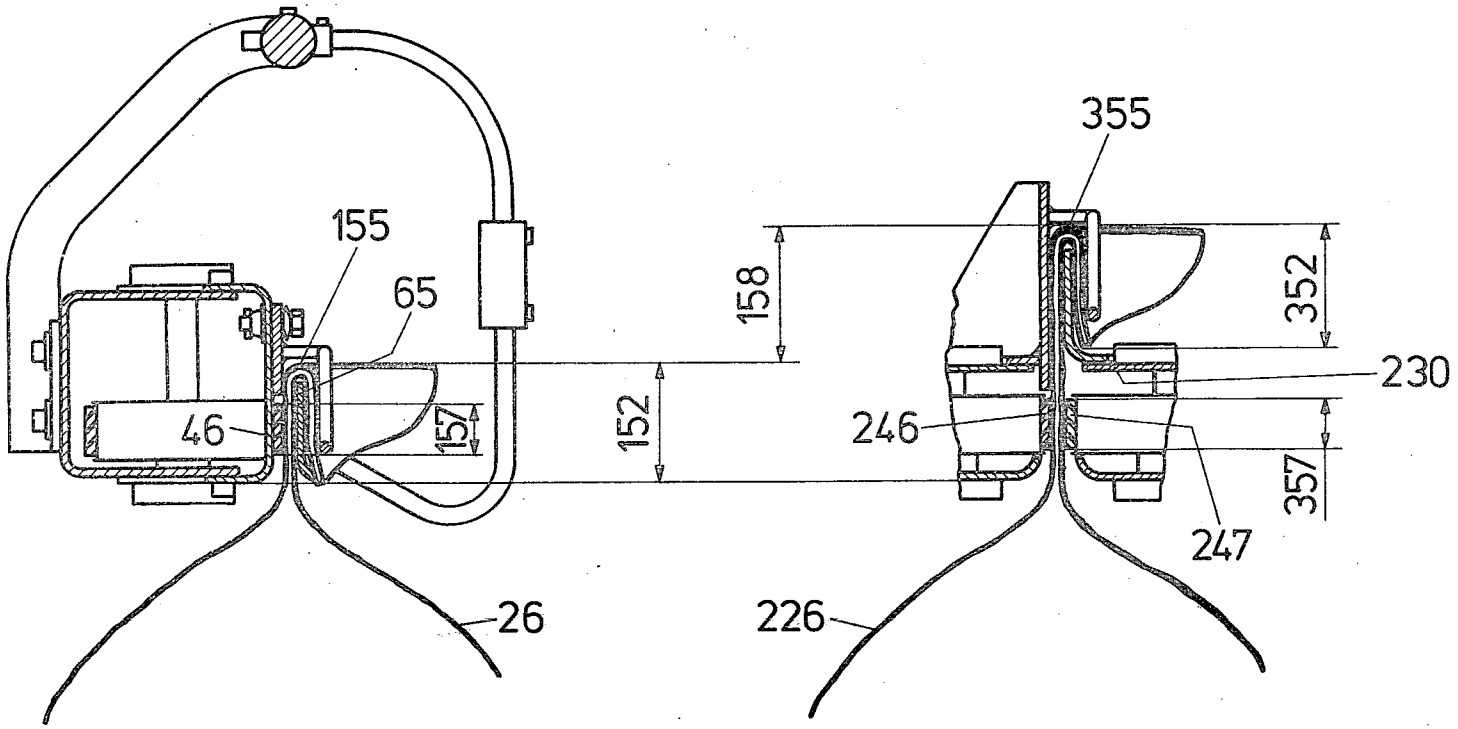
FIG. 10 shows a comparison to the prior art. The inventive bag folding apparatus is shown on the left and corresponds to the position of FIG. 7.

In the comparison of FIG. 10, on the lefthand side the above-described inventive bag folding apparatus including a presssure application band 46 and a folding ledge 65 are shown, in fact, in repetition of FIG. 7.

The bag folding apparatus shown on the righthand side according to the known art fastens the upper portion of the bag 226 between two pressure application bands 246,247 which have the same dimensions as the pressure application band 46. The pressure application bands 46, 246, 247 are all arranged on the same level because the transition between the filled portions of the bags 26, 226 and their upper portions have the same position and shape. It is now apparent that due to the pressure application band 247 and its cover 230, the region of the bag 226 to be folded must be located higher than the region to be folded of bag 26.

The region to be folded over can be defined by the folded edge region 152 of bag 26 or by the edge region 352 of the bag 226. The region of pressure application can be defined by the level 157 of the pressure application band 46 and the same level 357 of the pressure application bands 246, 247.

In the inventive bag folding apparatus the pressure application region at 157 and the region to be folded at 152 overlap partially. However, in the bag 226 the region to be folded at 352 is located much higher than the pressure application region at 357. Since the edge regions 152 and 352 must have the same dimensions for sewing, the bag 26 can be kept shorter by that distance which corresponds to the difference 158 in the level between the position of the fold 155 of the bag 26 and the position of the fold 355 of the bag 226. If it is considered that flour bags weighing, for example, 50 kg can be filled at a rate of more than 600 bags per hour, a difference in the level of a few centimeters for each bag results in very considerable saving in bag material over the course of a year.

The invention allows the most different variations in use and construction.

For example, the invention can also be used for recumbent bags, as is often the case in packaging solid objects.

In light bags whose edge regions are to be glued or welded after folding, the pressure application band and the folding ledge can assume the entire conveying operation in the bag folding apparatus so that at this location the conveyor belt or any other additional conveying arrangement are not needed.

The folding ledge could be constructed as a flat or round sectional member or in any other suitable shape.

The vertical adjustability of the stirrups can also be realized by a vertical adjustment of the horizontal bar.

Instead of using a bar as folding device, it would also be possible to use one of the known constructions with a horizontal triangular cam followed by a vertical triangular cam. In this case, it is also possible to use snap closures. When the folding device is not needed, a guide bar to the bag closing device can be arranged on the supporting structure for the first or the second pressure application roller. The switch for starting the bag closing operation may be arranged in the range of the bag folding apparatus in order to start this closing operation early enough.

If necessary, the second pressure application roller can also be driven, particularly when the bags are hard to fold. In this case, also a pair of pressure application rollers can be provided at the input.

Instead of using a folding ledge and a curved cam it would be possible, as in sheet metal forming, to use one or more rows of rollers which fold the edge zones progressively.

What is claimed is:

1. A bag folding apparatus for folding the region adjacent the open end of a filled bag with the filled bag also having an oppositely located closed end and an axis extending through the closed and open ends, comprising means for conveying the filled bag through a bag closing station having an input and an output end spaced apart by a bag folding zone, said conveying means including a planar conveying surface for supporting the closed ends of the filled bag passing through the bag closing station, a pressure application device including a pressure application band arranged to engage the bag at the input end in the region adjacent the open end thereof for moving the bag in combination with said conveying means through the bag folding zone to the output end of the bag closing station, said pressure application device including driving and deflecting rollers for said pressure application band with one of said rollers located at the input end and the other located at the output end of said bag closing station and with said rollers being rotatable about axes extending generally parallel with the axis of the bag being moved through the bag closing station and transversely of said conveying surface, a folding device located in the bag closing station and positioned adjacent said pressure application band, wherein the improvement comprises that said folding device is at least partially co-extensive in the direction of the axis of the bag moving through the bag closing station with said pressure application band in contact with the bag, a housing for supporting said pressure application band and extending from the input to the output end of the bag closing station, said folding device comprises a bar serving as a curved cam for folding the open end of the filled bag and extending from said input end to said output end of said bag closing station, said bar connected to said housing at the input end and spaced in the axial direction of the filled bag on the opposite side of said rollers from said conveying surface, said bar comprises a first part fixed to and extending obliquely outwardly from said housing toward the output end in generally parallel relation with said conveying surface and extending across the path of the open end of the filled bag entering the input end, a second part extending from the end of said first part spaced from said housing toward the output end in generally parallel relation with both the path of the filled bag traveling from the input end to the output end and said conveying surface, a third part extending from the end of said second part spaced from said first part in generally parallel relation with the path of the filled bag traveling from the input end to the output end and in converging relation with said conveying surface toward the output end, and a fourth part extending from the end of said third part spaced from said second part toward said output end in generally parallel relation with both the path of the filled bag traveling from the input end to the output end and said conveying surface.

2. A bag folding apparatus, as set forth in claim 1, wherein said pressure application device includes a counter-surface in juxtaposition to said pressure application device and forming a space therebetween for passing the part of the bag therethrough which is adjacent the open end with a part of the bag immediately adjacent the open end projecting beyond the space therebetween, said counter-surface forming a folding ledge, and means for supporting said folding ledge so that the portion of the bag adjacent the open end and projecting beyond the space therebetween can be folded over against the opposite side of said folding ledge from said counter-surface, said third part of said bar located on the opposite side of said folding ledge from said pressure application device.

3. A bag folding apparatus, as set forth in claim 1, wherein said counter-surface being a low-friction surface.

4. A bag folding apparatus, as set forth in claim 1, includes a frame, said housing mounted on said frame, said driving and deflecting rollers mounted in said housing, and said folding device being removably attached to said housing.

5. A bag folding apparatus, as set forth in claim 1, includes a frame, said housing mounted on said frame, said driving and deflecting rollers mounted in said housing, and said folding device being removably attached to said housing.

6. A bag folding apparatus, as set forth in claim 5, wherein said stirrups are made of spring steel.

7. A bag folding apparatus, as set forth in claim 5, wherein said projecting part of said frame includes a rod spaced from and extending generally parallel to said pressure application band and folding ledge and said stirrup being suspended from said bar.

8. A bag folding apparatus, as set forth in claim 2, wherein said folding ledge has a first end at the input end of the bag closing station at which a filled bag having an open end is introduced between said pressure application band and said counter-surface of said folding ledge and a second end located at the output end of the bag closing station, and a pair of pressure application rollers arranged to receive the folded open end of a filled bag and located at the second end of said folding ledge for smoothing the fold formed.

9. A bag folding apparatus, as set forth in claim 8 wherein said driving roller for said pressure application band is located at the second end of said folding ledge, and one of said pressure application rollers is mounted on the axle of said driving roller.

10. A bag folding apparatus, as set forth in claim 2, wherein said pressure application band having a surface contacting the bag affording increased friction with the bag being moved between said band and said counter-surface.

11. A bag folding apparatus, as set forth in claim 10, wherein said pressure application band comprises a belt having a toothed surface forming the surface contacting the bag.

12. A bag folding apparatus, as set forth in claim 11, wherein the opposite surfaces of said belt are toothed surfaces.

13. A bag folding apparatus for folding the region adjacent the open end of the filled bag with the filled bag also having an oppositely located closed end and an axis extending through the closed and open ends, comprising means for conveying the filled bag through a bag closing station, a pressure application device including a pressure application band arranged to engage the bag in the region adjacent the open end thereof for moving the bag in combination with said conveying means through the bag closing station, said pressure application device including driving and deflecting rollers for said pressure application band with said rollers being rotatable about axes extending generally parallel with the axis of the bag being moved through the bag closing station, a folding device located in the bag closing station and positioned adjacent said pressure application band, wherein the improvement comprises that said folding device is at least partially co-extensive in the direction of the axis of the bag moving through the bag closing station with said pressure application band in contact with the bag, said pressure application device includes a counter-surface in juxtaposition to said pressure application device and forming a space, therebetween for passing the part of the bag therethrough which is adjacent the open end with a part of the bag immediately adjacent the open end projecting beyond the space therebetween, said counter-surface forming a folding ledge, means for supporting said folding ledge so that the portion of the bag adjacent the open end and projecting beyond the space therebetween can be folded over against the opposite side of said folding ledge from said counter-surface, a frame, a housing mounted on said frame, said frame having a part projecting from said pressure application band in the direction in which the open end of the bag extends from the space between said pressure application band and said counter-surface, said means for supporting said folding ledge comprises stirrups elastically suspended from the projecting part of said frame toward said folding ledge, said projecting part of said frame includes a rod spaced from and extending generally parallel to said pressure application band and folding ledge and said stirrup being suspended from said rod, and said rod having cross bores therein for receiving and suspending said stirrups.

14. A bag folding apparatus, as set forth in claim 13, including a device for securing said stirrups in said bore for adjusting the length of insertion of said stirrups into the cross bores in said rod.

15. A bag folding apparatus, as set forth in claim 14, wherein said stirrups each have a first end secured to said rod and a second end secured to said folding ledge, and a first sleeve located intermediate the first and second ends of said stirrup for adjusting the dimension of said stirrup between the first and second ends thereof.

16. A bag folding apparatus, as set forth in claim 15, wherein a second sleeve is mounted on the second end of each said stirrup with the axis of said second sleeve extending parallel to the direction of movement of the bag between said pressure application band and counter-surface, and fastening screws connected to said sleeve and securing said folding ledge thereto.

17. A bag folding apparatus for folding the region adjacent the open end of a filled bag with the filled bag also having an oppositely located closed end and an axis extending through the closed and open ends, comprising means for conveying the filled bag through a bag closing station, a pressure application device including a pressure application band arranged to engage the bag in the region adjacent the open end thereof for moving the bag in combination with said conveying means through the bag closing station, said pressure application device including driving and deflecting rollers for said pressure application band with said rollers being rotatable about axes extending generally parallel with the axis of the bag being moved through the bag closing station, a folding device located in the bag closing station and positioned adjacent said pressure application band, wherein the improvement comprises that said folding device is at least partially co-extensive in the direction of the axis of said bag moving through the bag closing station with said pressure application band in contact with the bag, said pressure application device includes a counter-surface in juxtaposition to said pressure application device and forming a space therebetween for passing the part of the bag therethrough which is adjacent the open end with a part of the bag immediately adjacent the open end projecting beyond the space therebetween, said counter-surface forming a folding ledge, means for supporting said folding ledge so that the portion of the bag adjacent the open end and projecting beyond the space therebetween can be folded over against the opposite surface of said folding ledge from said counter-surface, a frame, said housing mounted on said frame, said frame having a part projecting from said pressure application band in the direction in which the open end of the bag extends from the space between said pressure application band and said counter-surface, said means for supporting said folding ledge comprises stirrups elastically suspended from the projecting part of said frame toward said folding ledge, said projecting part of said frame includes a rod spaced from and extending generally parallel to said pressure application band and folding ledge and said stirrup being suspended from said rod, a pair of pressure application rollers arranged to receive the folded open end of a filled bag and located at the output side of said folding ledge for smoothing the fold formed, said driving roller for said pressure application band is located at the output side of said folding ledge, one of said pressure application rollers is mounted on the axle of said driving roller, a bearing for freely rotatably supporting the other one of said pressure application rollers, elastic members secured to said rod and extending therefrom transversely of the direction of said rod, and said bearing for the other one of said pressure application rollers is secured to said elastic members at the end thereof spaced from said rod.

18. A bag folding apparatus, as set forth in claim 17, wherein said rod having cross bores therein for suspending said elastic members, and a device for securing said elastic members on said rod for adjusting the length of insertion of said elastic member into the cross bores in said rod.

19. A bag folding apparatus, as set forth in claim 17, including a pin stationarily secured to said elastic members, said pin being arranged in parallel relation with said rod, and said bearing for the other one of said pressure application rollers is clamped to said pin.

* * * * *